US009091492B2

(12) United States Patent
Visentin et al.

(10) Patent No.: US 9,091,492 B2
(45) Date of Patent: Jul. 28, 2015

(54) RADIATOR FASTENING SYSTEM FOR HINGE SUPPORT

(75) Inventors: Simone Visentin, Santa Lucia di Piave (IT); Marco Argenton, Cinto Caomaggiore (IT); Michele Pravato, Conegliano (IT); Michele Peterle, Mareno di Piave (IT)

(73) Assignee: I.R.C.A. S.P.A. INDUSTRIA RESISTENZE CORAZZATE E AFFINI, San Vandemiano (IT)

( * ) Notice: Subject to any disclaimer, the term of this patent is extended or adjusted under 35 U.S.C. 154(b) by 880 days.

(21) Appl. No.: 13/255,887

(22) PCT Filed: Mar. 10, 2010

(86) PCT No.: PCT/IB2010/000507

§ 371 (c)(1),
(2), (4) Date: Sep. 9, 2011

(87) PCT Pub. No.: WO2010/103385

PCT Pub. Date: Sep. 16, 2010

(65) Prior Publication Data

US 2012/0000624 A1 Jan. 5, 2012

(30) Foreign Application Priority Data

Mar. 10, 2009 (IT) ..... RM2009A000107

(51) Int. Cl.

| | |
|---|---|
| ***F28F 9/00*** | (2006.01) |
| ***F28F 1/20*** | (2006.01) |
| ***A47K 10/06*** | (2006.01) |
| ***F24D 19/02*** | (2006.01) |
| ***F28F 1/22*** | (2006.01) |

(Continued)

(52) U.S. Cl.

CPC . *F28F 1/20* (2013.01); *A47K 10/06* (2013.01); *F24D 19/02* (2013.01); *F24D 19/0209* (2013.01); *F24D 19/0283* (2013.01); *F24D 19/0293* (2013.01); *F28F 1/22* (2013.01); *F24D 2220/2054* (2013.01); *F28D 2021/0035* (2013.01); *F28D 2021/0036* (2013.01)

(58) Field of Classification Search

CPC ..... F28F 1/20; F28F 1/22; F24D 19/0209; F24D 19/0223; F24D 19/0293; F24D 19/0283; F24D 19/02; F24D 2220/2054; F28D 2021/0035; F28D 2021/0036; A47K 10/06

USPC ..... 165/67, 76, 77

See application file for complete search history.

(56) References Cited

U.S. PATENT DOCUMENTS

| | | | | |
|---|---|---|---|---|
| 1,927,991 | A * | 9/1933 | Pendleton | 165/57 |
| 2011/0108687 | A1 * | 5/2011 | Wilson | 248/213.3 |

FOREIGN PATENT DOCUMENTS

| | | |
|---|---|---|
| CN | 201005608 | 1/2008 |
| DE | 18 01 886 U | 12/1959 |

(Continued)

*Primary Examiner* — Tho V Duong

(74) *Attorney, Agent, or Firm* — Davis, Malm & D'Agostine, P.C.

(57) ABSTRACT

A wall-mounted radiator comprising a support (1) adapted to make it tilting with respect to a support wall and possibly comprising blocking means (2) of the radiator to maintain it in a proximal or distal position with respect to said support wall. The support may be adapted to be associated with the radiator (3) so as to allow to adjust the fastening point so as to facilitate the installation thereof. Moreover, the support (1) may comprise a removable part (11*c*) in order to further simplify the installation of the radiator.

20 Claims, 16 Drawing Sheets

(51) Int. Cl.
*F28F 7/00* (2006.01)
*F28D 21/00* (2006.01)

(56) References Cited

FOREIGN PATENT DOCUMENTS

| | | | | |
|---|---|---|---|---|
| DE | 41 29 299 | A1 | | 3/1992 |
| DE | 195 48 255 | A1 | | 4/1997 |
| DE | 298 05 991 | U1 | | 6/1998 |
| DE | 20 2004 004285 | U1 | | 5/2004 |
| DE | 20 2004 008946 | U1 | | 8/2004 |
| DE | 20 2008 010425 | U1 | | 10/2008 |
| EP | 0 733 867 | A | | 9/1996 |
| EP | 1 686 340 | A2 | | 8/2006 |
| EP | 1 754 943 | A1 | | 2/2007 |
| GB | 2096451 | A | * | 10/1982 |
| GB | 2 148 097 | A | | 5/1985 |
| GB | 2148097 | A | * | 5/1985 |
| GB | 2150685 | A | * | 7/1985 |
| GB | 2251298 | A | * | 7/1992 |
| GB | 2 446 465 | A | | 8/2008 |
| JP | 7 248196 | A | | 9/1995 |
| WO | 88 06260 | A1 | | 8/1988 |

* cited by examiner

RADIATOR FASTENING SYSTEM FOR HINGE SUPPORT

FIELD OF THE INVENTION

The present invention relates to a radiator with related fastening system, in particular a wall-mounted radiator.

BACKGROUND ART

Wall-mounted radiators are generally installed during the building step or when upgrading an environment and are not likely removed unless for their maintenance or for painting the walls on which they are installed.

Generally, these radiators have a vertical development and may comprise several modules associated in relation to the needs.

Two or more support brackets generally protrude from the wall, to which a radiator is bolted.

Removing radiators is not within everybody's reach due to the efforts required to unfasten them from the support brackets and due to the equipment required to disconnect the inflow and outflow manifolds of the vector fluid from the distribution installation.

For this reason, dusts and mites which are difficult to be removed accumulate on the rear surfaces of the radiators, i.e. those facing the walls. Hence, the air breathed in an environment in which the radiators are full of dust, is unhealthy.

Making the rear surfaces of the radiators smooth may be helpful, but the performance of the radiators decreases because the finnings in which the dusts and mites accumulate are required for heat exchange.

Installing traditional radiators is costly due to the same aforementioned problems, because it requires the intervention of two operators to install a radiator due to the precision required in nearing the radiator to the support brackets and due to the fact that while one of the two operators holds the radiator, the other one bolts it to the brackets.

Therefore, the technical problem is that of solving the difficulty in installing a radiator and subsequently removing the dusts which accumulate thereon over time.

SUMMARY OF THE INVENTION

It is the object of the present invention to provide a radiator fastening system adapted to solve the aforesaid problem.

The object of the present invention is a radiator fastening system, in particular for wall-mounted radiators, which, according to a particular embodiment, comprises at least a hinge support comprising a hole defining a seat of a pivot, integral with the support or with part of the radiator, and having its own axis, the support being adapted to be wall-mounted so that the axis of said hole is parallel to said wall, blocking means adapted to prevent/allow the rotation of said radiator with respect to said support in order to keep it in a predetermined position with respect to a wall. The application of the present invention is particularly advantageous for electric radiators in which at least one heating element is within the radiator itself, even more preferably within the lower area of the radiator.

When the upper part of the radiator is unfastened from the upper support, the radiator may advantageously rotate about the lower support by some degrees, i.e. becoming tilting, thus allowing access to the surface of the radiator normally facing the wall, normally made inaccessible by conventional radiators.

It is a further object of the invention to provide a tilting radiator adapted to solve the aforesaid problem.

Therefore, the object of the present invention is also a radiator which, according to a particular embodiment, comprises a fastening system as above, in which said at least one support is adapted to hinge a part of the radiator to a wall, so as to make the radiator pivotally associated with the wall, being able to rotate between a first distal position and a second position which is proximal to said wall.

Such a radiator is best applied when said hinge support is arranged in a lower part of the radiator according to a wall-mounted installation configuration thereof, and when the radiator itself comprises blocking means adapted to allow the upper part of the radiator to be blocked/unblocked to/from a proximal position with respect to the support wall.

It is a further object of the present invention to disclose a radiator comprising a cover system adapted to increase the heat exchange surface thereof and particularly adapted to simplify its maintenance and enhance its performance.

The dependent claims describe preferred embodiments of the invention, thus forming an integral part of the present description.

BRIEF DESCRIPTION OF THE DRAWINGS

Further features and advantages of the invention will become more apparent in light of the detailed description of preferred but non-limiting embodiments of a radiator fastening system and a radiator, shown by way of a non-limiting example with the aid of the accompanying drawings, in which.

The same reference numbers and letters in the figures identify the same elements or components.

DETAILED DESCRIPTION OF A PREFERRED EMBODIMENT OF THE INVENTION

Figure 1:
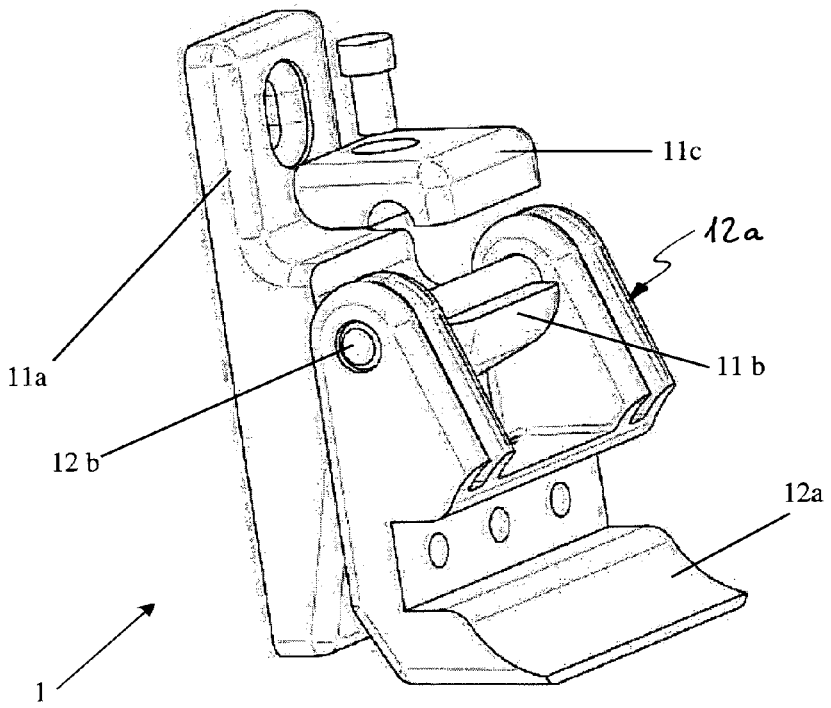
FIG. 1 depicts an axonometric view of a detail of a lower support of the fastening system of the invention.

A radiator fastening system in accordance with the present invention comprises at least one lower hinge support 1 adapted to hinge a radiator 3 by one area thereof, preferably a lower area, to a support wall and an upper support comprising blocking means 2 adapted to block radiator 3 in a proximal position with respect to the support wall. Said upper support is preferably adapted to fasten an upper part of radiator 3 for keeping it in a proximal position with respect to the support wall.

The lower support acts as a hinge, whereby a radiator pivotally bound to a wall by means of such a lower hinge support 1 may rotate so as to make the surfaces, normally close to the support wall, accessible from the top so as to facilitate the cleaning operations of these surfaces, and possibly the operations of painting the support wall.

A radiator of electric type may be made tilting so that any part thereof may be separated from the support wall during maintenance. It is preferred to be made tilting with respect to the lower part because this allows undoubted advantages when the radiator itself is installed, as disclosed hereinafter. However, the electric radiator could be made tilting even with respect to a side or upper part thereof.

Moreover, it is preferable that the radiator tilts with respect to a lower part thereof when it is a water radiator, e.g. connected to an external hydraulic supply circuit, because making a water joint with the heat-carrying fluid input and output manifold is simpler.

The lower support 1 is adapted to fasten the radiator 3 in a low or lower area and the upper support 2 is adapted to fasten the radiator 3 in a high area, the radiator areas being defined as high and low with respect to a wall-mounting position or to a position of mounting to an equivalent support structure of the radiator. The lower hinge support 1 comprises a wall fixing bracket 11*a*, and a protrusion 11*b* substantially perpendicular to said fixing bracket 11*a* and shaped to accommodate a removable completion element 11*c* of the lower support so that when said completion element 11*c* is associated with said protrusion 11*b*, a through hole is defined to be perpendicular to a part of the body of the fixing bracket 11*a* and of the body of the protrusion 11*b*, adapted to be engaged by a pivot 12*b* integral with the radiator 3.

Therefore, said protrusion 11*b* is a sort of console integral with the fixing bracket 11*a* in which approximately half of the seat of the through hole is obtained, while the remaining part of the hole seat is obtained in the completion element 11*c*. It is preferred that said lower support 1 is fixed to the wall so that the fraction of the seat of the through hole obtained in protrusion 11*b* is parallel to the floor and facing upwards. Thereby, the radiator may be neared from the top by resting it by means of said pivot 12*b* in the seat of the through hole and then by associating the completion element 11*c* so as to force said pivot 12*b* to remain pivotally bound to the lower support 1. Said completion element 11*c* allows to safely use the radiator 3 by preventing the unfastening thereof upon impacts or during its rotation.

Figure 3:
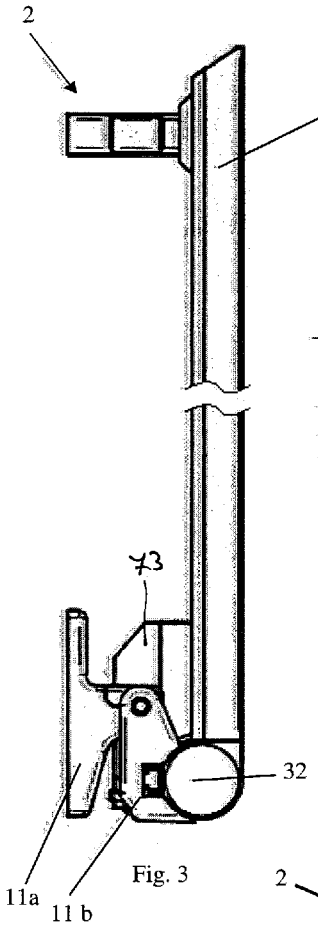
FIG. 3 represents a side view of a radiator mounted to the wall by means of the fastening system of the invention.
Figure 4:
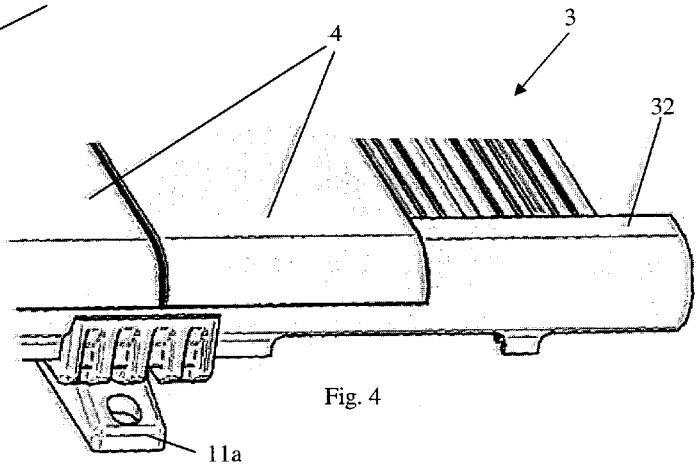
FIG. 4 depicts an axonometric bottom view of a detail of the radiator emphasizing the lower support in FIG. 1.
Figure 5:
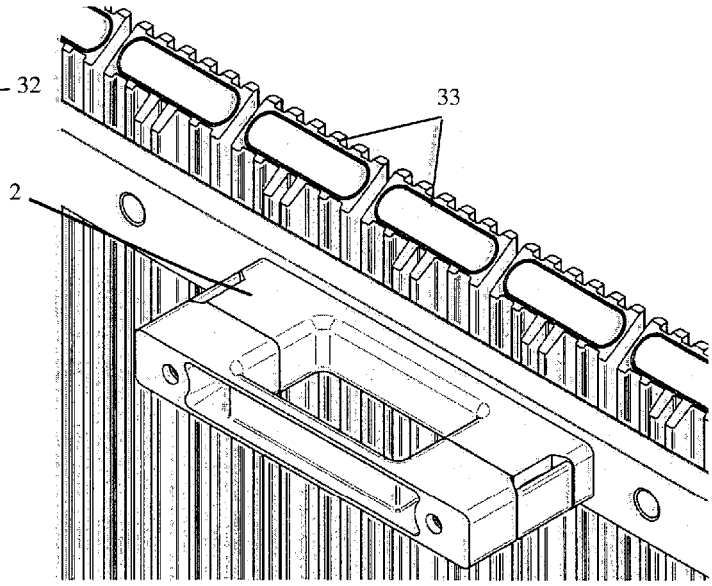
FIG. 5 depicts an axonometric top view of the same radiator in FIG. 4 emphasizing the upper support in FIG. 2.

According to the preferred embodiment shown with the aid of FIGS. 1 and 3, the lower support 1 may comprise a connecting body 12*a* of said pivot 12*b* to radiator 3. In particular, it is preferred that the lower part of the radiator comprises a longitudinal groove 31, e.g. of slide type, having a substantially C-shaped profile section adapted to be coupled with a small bar 12*c* so that this small bar may only move slidingly along said groove 31. Thereby, the correct association point of support 1 may be adjusted with respect to radiator 3.

The small bar 12*c* comprises one or more threaded holes 60 to be connected with said connecting body 12*a* by means of screws 61, pivots or the like.

Figure 6C:
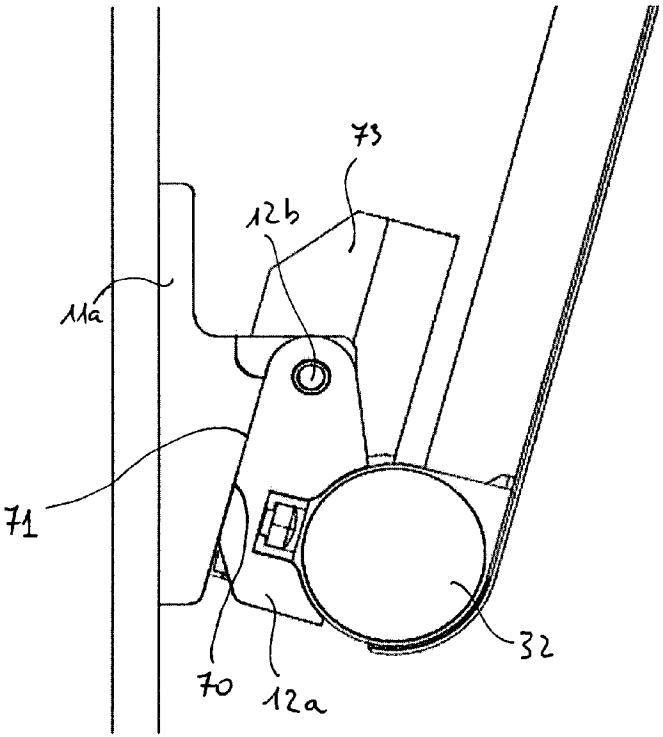
FIG. 6*c* depicts an enlarged side view of lower support and radiator in FIG. 6*b* assembled together in an intermediate and transitory closing or opening position.
Figure 6:
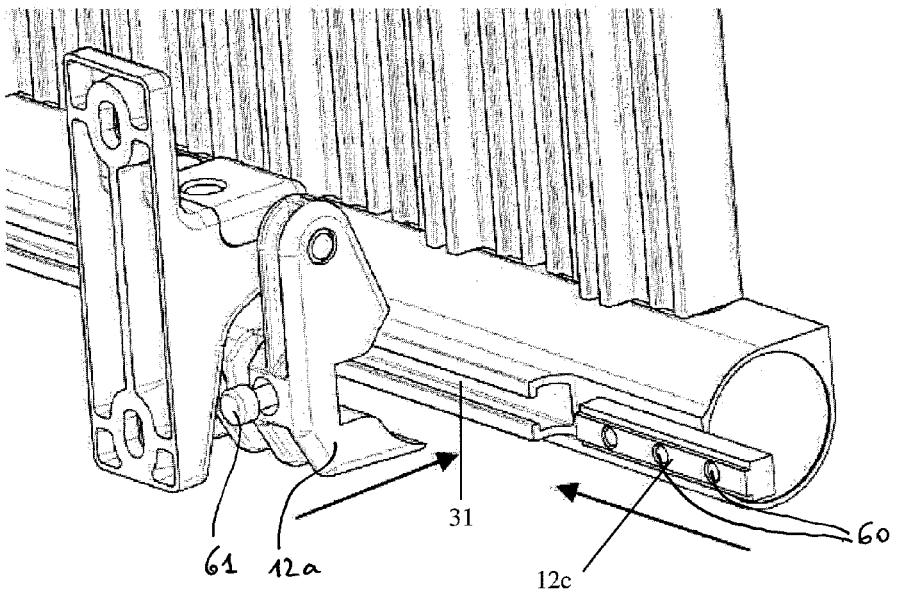
FIG. 6 depicts a step of the operation of mounting the lower support in FIG. 1 to a radiator.
Figure 6A:
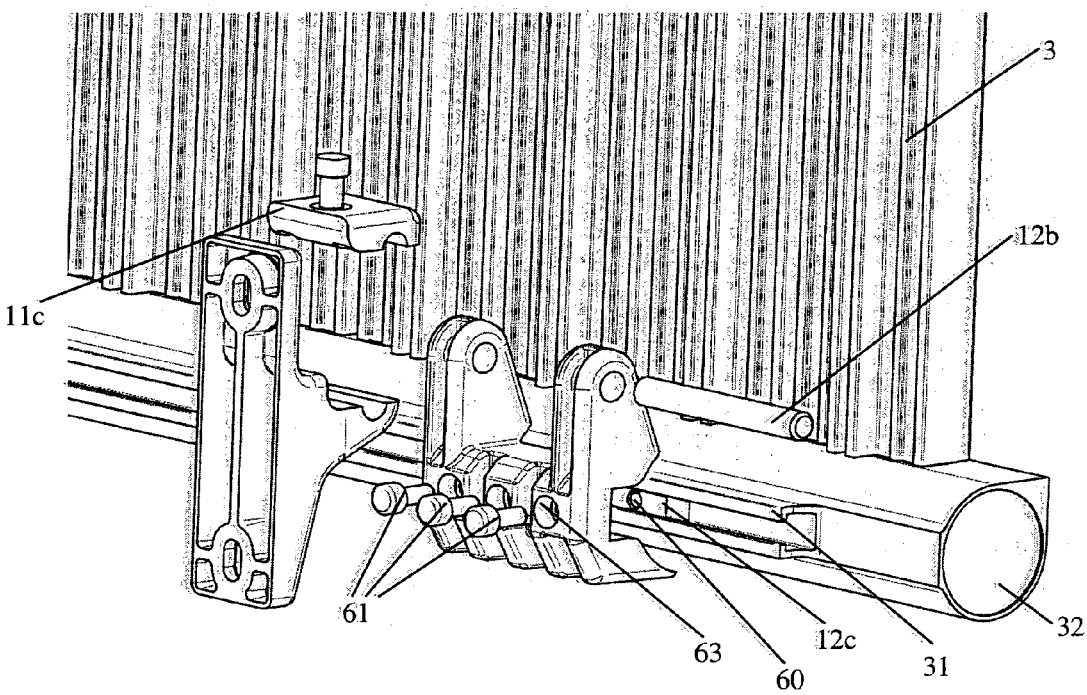
FIG. 6*a* depicts another step of mounting the lower support in FIG. 1 to a radiator.
Figure 6B:
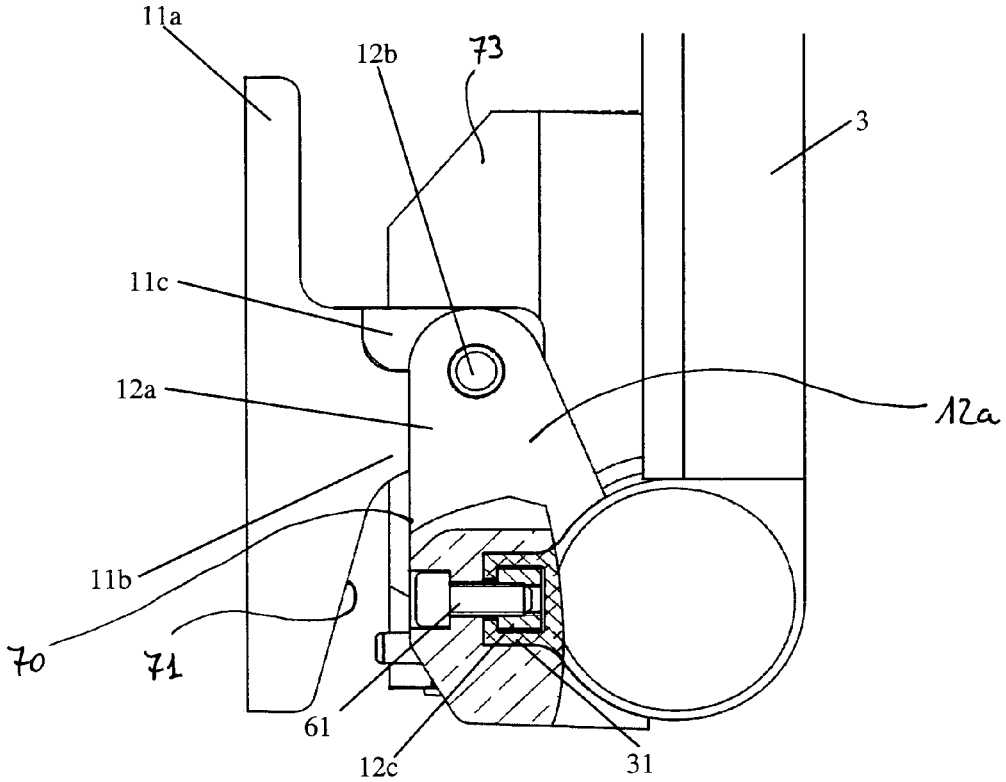
FIG. 6*b* depicts a side view, partially cross-sectioned, of lower support and radiator assembled together.
Figure 6D:
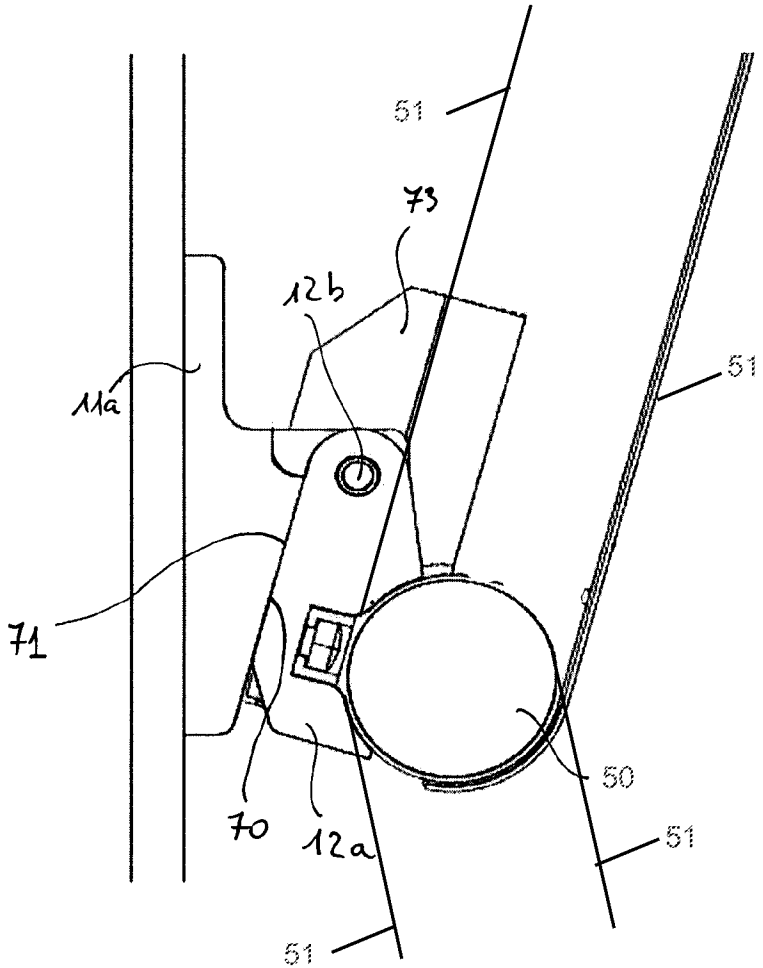
FIG. 6*d* is a view similar to that a FIG. 6*c*, with the lower support of FIG. 1 and the radiator embodiment of FIGS. 15-17 and 19.

FIG. 6 depicts a first mounting step in which the small bar 12*c* is inserted into the groove 31 of radiator 3. FIG. 6*a* depicts a second mounting step in which the screws 61 are inserted, through the respective holes 63 provided in the connecting body 12*a*, into the corresponding threaded holes 60 of the small bar 12*c*. FIG. 6*b* depicts a side view, partially cross-sectioned, of the lower support and the radiator in an assembled position. According to the extension of the protrusion 11*b* with respect to the plate or bracket 11*a*, an inclination angle of radiator 3 and body 12*a* with respect to the wall to which the radiator is fixed may be obtained, variable between 0° and about 90° or more.

In addition to the function of supporting the radiator 3, the lower hinge support 1 also advantageously ensures the safe stopping of the radiator during its rotation without using devices such as chains, cables, cords, etc. Indeed, the connecting body 12*a* is provided with a surface 70 which, upon the rotation of radiator 3 from the position in FIG. 3 to the position in FIG. 3*a*, abuts against a corresponding surface 71 of the fixing bracket 11*a*, as shown in FIG. 6*c*.

The configuration of these surfaces 70, 71 may be chosen so as to define different maximum opening angles of radiator 3 with respect to the support wall thereof. The maximum opening angle may preferably vary, for example, in a range between 0° and 60° or between 0° and 45°, but other greater angles are also possible.

With reference to FIGS. 6*b* and 6*c*, radiator 3 may be provided with a container 73 at the lower area of its rear face or rear radiating surface 33*b*, which container accommodates an electronic control and adjustment board therein.

Figure 3A:
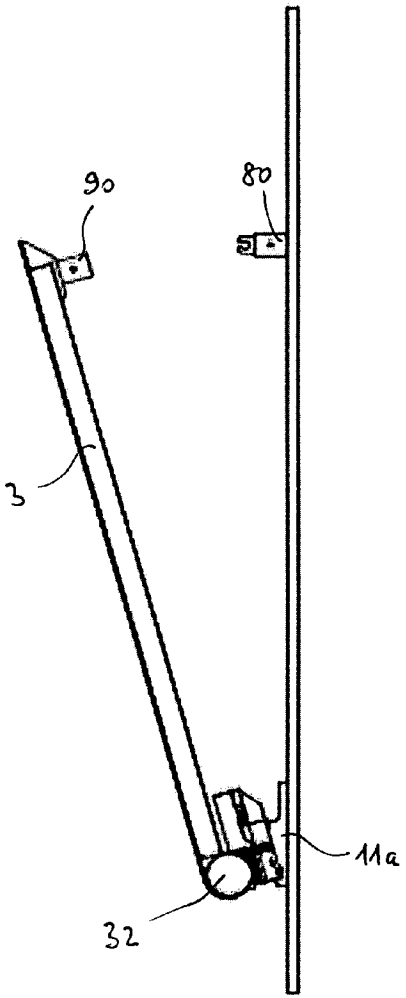
FIG. 3*a* depicts a side view of the radiator in FIG. 3 in an intermediate and transitory closing or opening position.

Advantageously, the configuration of fixing bracket 11*a* and connecting body 12*a* which connects the radiator 3 to the bracket 11*a* is such as to ensure a minimum safety distance between said container 73 and the support wall of the radiator whereby a contact between the container 73 and said support wall is avoided when the radiator rotates from the proximal position with respect to the support wall (FIG. 3) to the distal position with respect to the support wall (FIG. 3*a*).

The upper support 2 serves the function of blocking the rotation of the radiator with respect to the lower support 1. In particular, radiator 3 may be blocked in the proximal position with respect to the support wall (FIG. 3) and radiator 3 may be disengaged from said proximal position by means of said upper support 2, thus allowing the rotation thereof with respect to the lower hinge support 1.

According to a first preferred embodiment of the upper support 2, it comprises:

a first part to be fixed to the support wall of the radiator, comprising a respective fixing bracket 22*a* in which at least a first seat 22*b* and at least a second seat 22*c* are obtained, said bracket 22*a* being adapted to be wall-mounted so that the axis of said first seat 22*b* is perpendicular to the wall and the axis of said second seat 22*c* is perpendicular to the axis of said first seat 22*b*, thus intercepting it, and a second part, integrally fixed to the radiator and suitable for being engaged with said first part of the upper support 2, comprising at least a first pin 21 directly or indirectly integral with the radiator and adapted to engage said at least one first seat 22*b;* at least a second pin or counterpin 23 adapted to engage said at least a second seat 22*c* until intercepting said first pin 21, thus avoiding that this may slip off the related seat.

Figure 2:
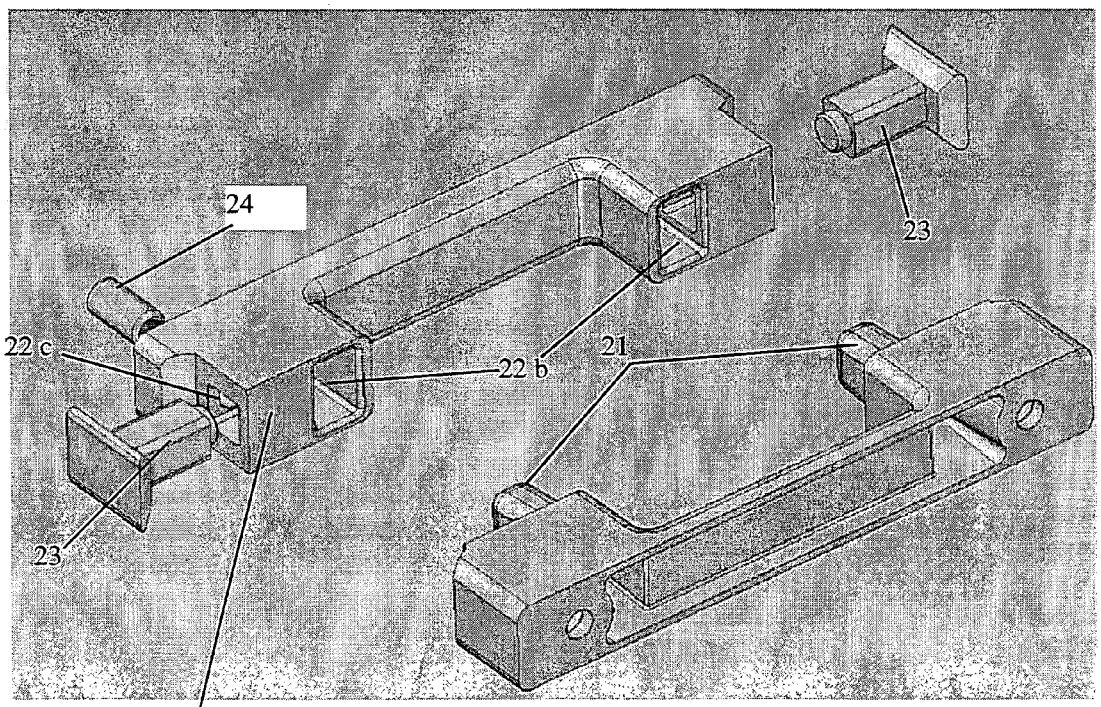
FIG. 2 depicts an axonometric view of a detail of a first variant of an upper support of the fastening system of the invention.
Figure 2B:
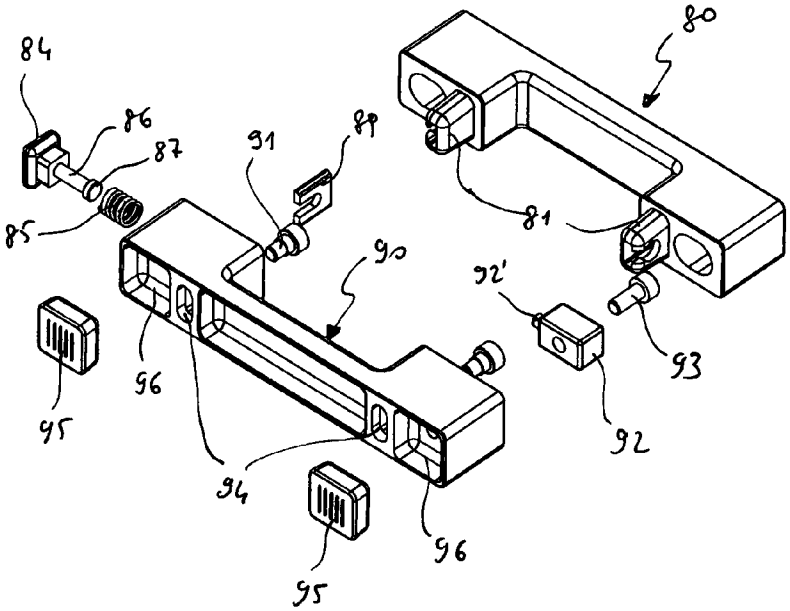
FIGS. 2*a* and 2*b* depict exploded axonometric views of a second variant of an upper support of the fastening system of the invention.
Figure 2A:
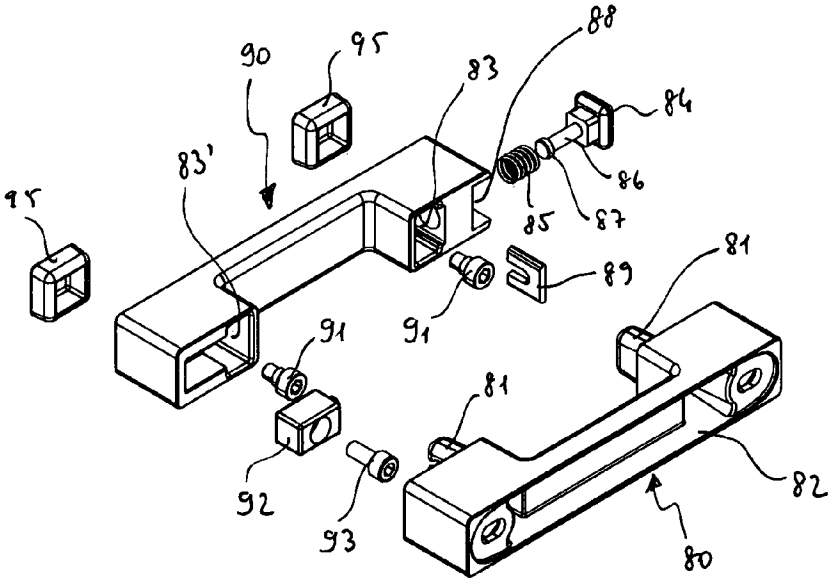

According to the preferred embodiment shown with the aid of FIG. 2, two or more upper supports may be associated in a single fixing bracket 22*a*.

Moreover, said pin 21 or said pins 21, 23 may be associated with the radiator at a later time or be constructed in one piece therewith or with part thereof.

In a second preferred embodiment of the upper support 2, the pins 23 shown in FIG. 2 are not included.

This second embodiment of the upper support 2 comprises a first part 80 to be fixed to the support wall of the radiator, comprising a fixing bracket 82 provided with two pins or protrusions 81, and a second part 90 integrally fixed to the radiator and suitable for being engaged with said first part 80 of the upper support 2, comprising two seats 83, 83' for accommodating the respective pins 81.

The second part 90 of the upper support 2 is advantageously provided with a normally closed button 84 with return spring 85 which permits unfastening of said second part 90, by means of pressure on the button itself, and thus unfastening of radiator 3 from the first part 80, and thus from the support wall.

The button 84 comprises a cylindrical pivot 86 provided at its terminal end with a cylindrical portion 87 of a greater diameter than the pivot 86 itself. The return spring 85 is accommodated on said pivot 86. The button 84 is accommodated in a seat 88 obtained in the second part 90. A stroke-end element 89 of button 84 is also provided in seat 88.

In the second part 90 of the upper support 4, on the side opposite the that which accommodates button 84, there is provided the seat 83' larger than the seat or recess 83 and has such a shape as to accommodate a deformable plastic element 92. This deformable element 92 is provided with a protrusion 92' of the same material.

Pins 81 of the first part 80 of the upper support 2 are provided instead with a recess, e.g. a T-shaped throat, having a first part 81' for receiving the protrusion 92' of element 92 and the cylindrical portion 87 of pivot 86, respectively, and a second part 81" to permit unfastening the protrusion 92' from the respective pin 81 when applying a determinate force, and to permit unfastening the cylindrical portion 87 from the respective pin 81, respectively.

Figure 2C:
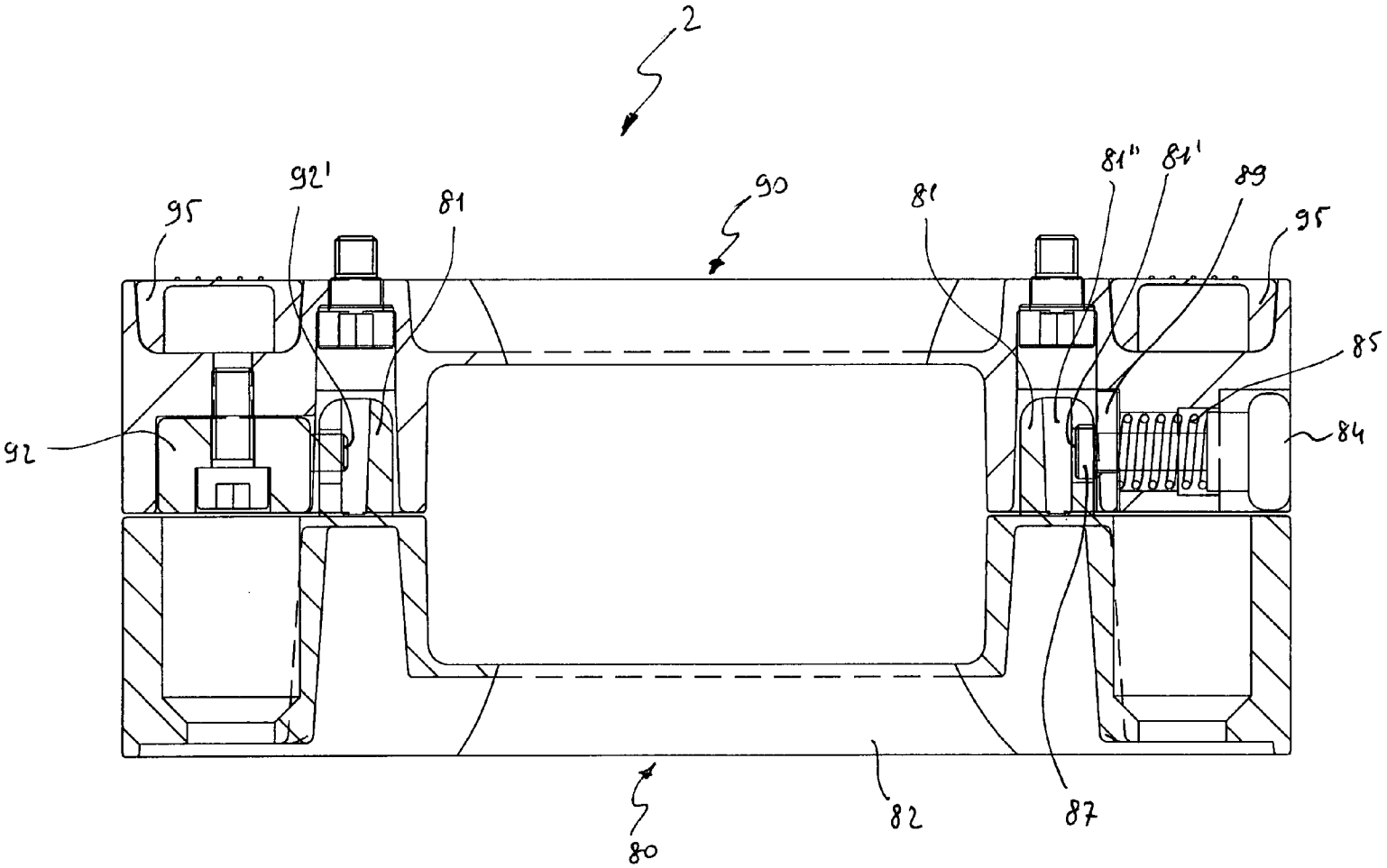
FIG. 2*c* depicts a top view of the support in FIGS. 2*a* and 2*b* in a closed position.
Figure 2D:
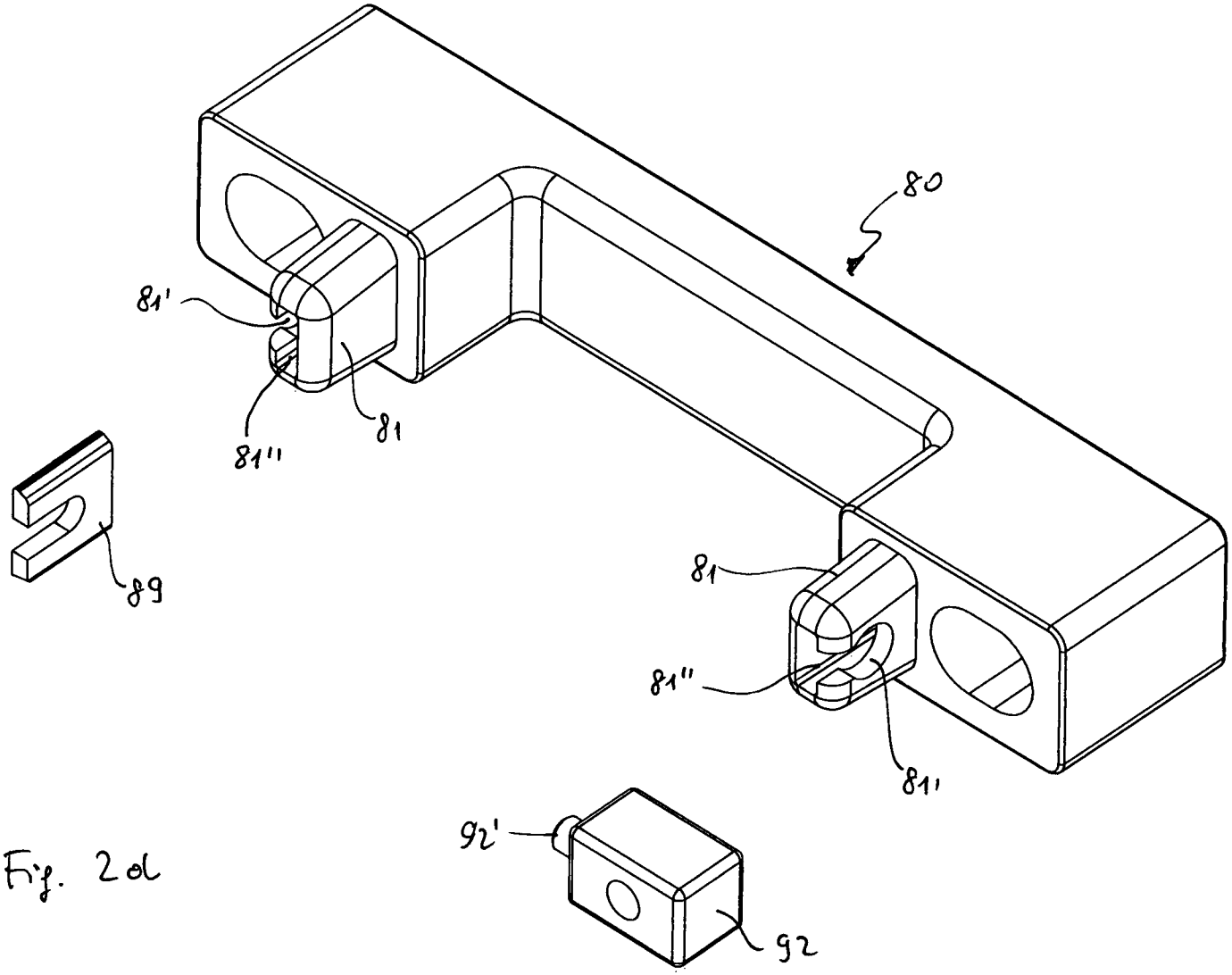
FIG. 2*d* depicts an axonometric view of a detail of the support in FIGS. 2*a* and 2*b;*

When the upper support 2 is in a closed position (FIG. 2*c*), the two parts 80 and 90 being engaged with each other, the return spring 85 is arranged between the button 84 and the stroke-end element 89. The cylindrical portion 87 of pivot 86 is beyond the stroke-end element 89 and is accommodated in the respective first part 81' of the recess of the first pin 81. On the opposite side, the protrusion 92' is accommodated by interference fitting in the respective first part 81' of the recess of the second pin 81.

When the radiator is required to rotate about the lower hinge support 1, pressure on button 84 will permit the cylindrical portion 87 of pivot 86 to push forwards in the second part 81" of the recess of the first pin 81, and said cylindrical portion 87 will slip off from the first pin 81, by exerting a manual pulling action on the second part 90 of support 2. Similarly, the protrusion 92' made of deformable material will slip off from the second pin 81, on the opposite side.

This second embodiment of the upper support 2 permits easy fastening/unfastening of the second part 90, integral with the radiator, to/from the first part 80 integral with the support wall of the radiator.

Including the element 92 made of deformable material, acting as a stop and working by interference fitting with the second pin 81, offers a calibrated resistance to the unblocking, thus avoiding accidental unfastening.

Moreover, suitable slots 94 are provided in the second part 90 of the upper support 2. Said slots 94 also serve the function of facilitating the centring of the positioning during the installation and permit to compensate for the thermal expansions of the radiator during the operation thereof.

Moreover, suitable rubber elements 95 are included, accommodated in respective seats 96 of the second part 90, to avoid scrapes on the radiator, in particular on the crosspiece, thus allowing the second part 90 or handle of the support 2 to slide to compensate for the thermal expansions.

The upper support 2 is advantageously configured so that, when the first part 80 and the second part 90 are engaged with each other, a space 100 is defined for accommodating the accessory elements, such as air humidification cup, perfume holders, etc.

A radiator 3, which is wall-mounted by means of said lower support 1 and upper support 2, is adapted to tilt with respect to said lower support 1 so as to be separated from the wall to facilitate cleaning operations.

Mounting the radiator itself is advantageously simplified as it first requires one or more fixing brackets 11*a* to be wall-mounted, the radiator to be neared to the lower support(s) until the pivot(s) 12*b* is(are) in the seats obtained in the cantilevers or protrusions 11*b*. At this point, the upper part of the heating system or radiator temporarily rests to the wall for mounting the completion element(s) 11*c*; the radiator is tilted to wall-mount the fixing bracket(s) 22*a*, 82 and finally, the pin(s) 21, 81 is(are) engaged in the related seats 22*b*, 83, 83'.

In the first embodiment, a snap pin 24 is provided to fix the counterpin 23 (FIG. 2). The radiator dimensions being precisely known, the second fixing brackets 22*a*, 82 may be wall-mounted before or after the first fixing brackets 11*a* are mounted.

Once the radiator is neared to the protrusions 11*b*, the radiator is blocked at the top by means of the upper support 2 and then the completion elements 11*c* are assembled.

The fixing brackets 11*a*, 22*a* and 82 may comprise holes or in any event means which allow the same to be wall-mounted.

Fixing the radiator to the wall may be preferably achieved by blocking means 2 comprising snap blocking elements (not illustrated) which advantageously permit to compensate for the mounting tolerances.

According to another aspect of the present invention, a radiator may integrally comprise both one or more pivots 12*b* and one or more pins 21, 81.

Figure 7:
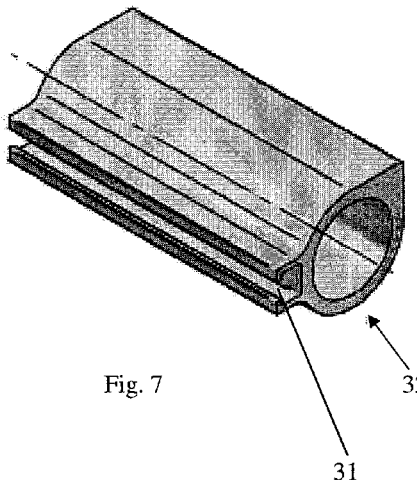
FIG. 7 depicts a view of a detail of an element of the radiator in FIG. 4.

In particular, a preferred embodiment of a tilting radiator comprises an upper tubular manifold (not shown) and a lower tubular manifold 32, seen in FIG. 7, in which said groove 31 is obtained longitudinally to the main axis thereof.

Figure 8:
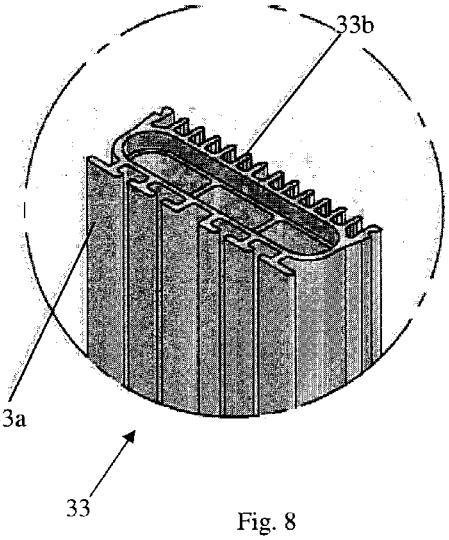
FIG. 8 depicts a view of a detail of an element of the radiator in FIG. 4.

One or more radiating elements 33 depicted in FIGS. 6 and 8 branch off with respect to said manifold 32.

These radiating elements 33 are internally hollow and have a more or less elongated shape, being able to have one or more inner partitions dividing the flow of the heat-carrying fluid. In particular, they have an elongated and flattened shape, so as to define a first face 33*a* intended to be seen when a radiator is wall-mounted, and a second face 33*b* intended to face the wall to which the radiator is intended to be mounted.

Both the radiating faces or surfaces 33*a* and 33*b* have tabs useful for an enhanced heat dispersion. Indeed, the tabs are adapted to increase the exchange surface and allow to secure accessories of various nature (towel holders, humidifiers, clothing hooks, etc.) by means of self-tapping screws which are engaged between the tabs themselves.

In particular, the tabs on the second face 33*b* are crests which longitudinally extend according to the longitudinal direction of the radiating elements. The tabs on face 33*b* are advantageously configured so as to define seats for self-tapping screws hence permitting the possible insertion of accessories of various type. The self-tapping screws are engaged between the tabs themselves thus allowing the accessories such as towel holders, humidifiers, clothing hooks, etc. to be fixed, for example.

Moreover, the two most peripheral crests may be conveniently shaped so as to be associated with the fixing means 41, such as tabs or toothed hooks, of at least one possible cover 4, thus permitting various aesthetic customizations.

Figure 9:
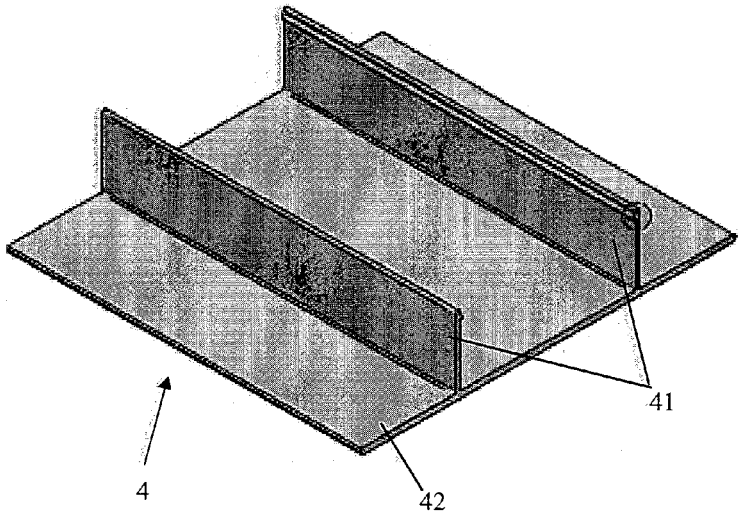
FIG. 9 depicts a view of a detail of an element of the radiator in FIG. 4.

An example of cover 4 is shown in FIG. 9. Said cover 4 may comprise a wide surface 42, the toothed hooks 41 extending perpendicularly thereto, which hooks define said fixing means to one or more radiating elements.

Thereby, the covers of the radiator may be replaced without necessarily applying a painting or a new painting thereon.

Figure 10:
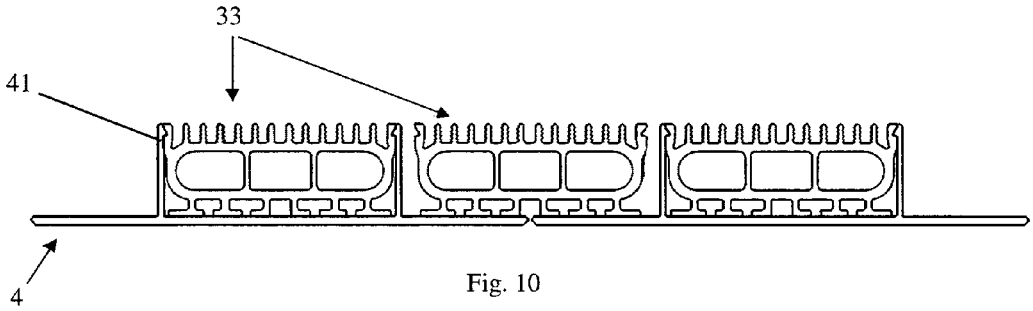
FIG. 10 depicts a cross-section view of the radiator in FIG. 4 emphasizing the element in FIG. 9.
Figure 11:
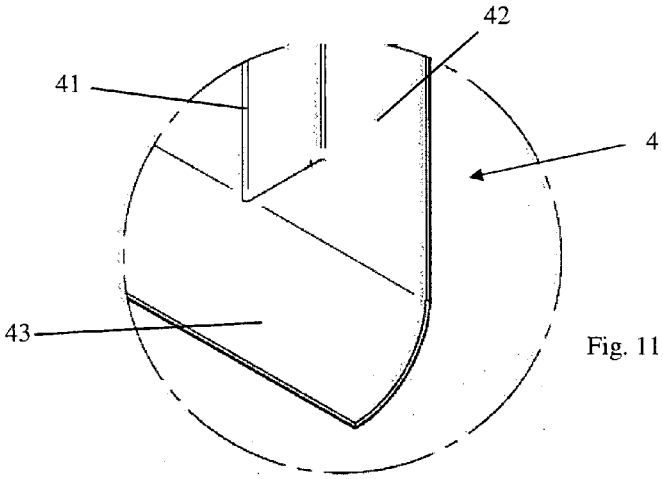
FIG. 11 depicts a portion of a detail of the element in FIG. 9 as depicted in FIG. 4.

In FIG. 10, a cross-section view is shown of a radiator comprising three radiating elements 33 to which two covers 4 are associated. The covers may be of metal material or any other material which enhances the heat exchange between the radiator and the environment. For this reason, it is preferred that said toothed hooks 41 define some tabs extending over the whole length of the cover, i.e. over the whole length of a radiating element to which the cover is intended to be associated. In order to enhance the thermal contact between one cover and one radiator, cover 4 may comprise an area or portion 43 of surface 42, on one or both lower and upper sides, with no tabs and rounded so as to adhere to a lower and/or upper manifold, if any, as shown in FIG. 11.

Said tabs or toothed hooks 41 are shaped so as to facilitate the grooves to be assembled in a clamping solution. Moreover, said tabs or toothed hooks 41 are shaped so as to ensure the mechanical contact and the heat transmission between the radiating elements 33 and the external environment. Said tabs or toothed hooks 41 represent the aesthetical finishing of the radiator with respect to the side view.

Figure 12:
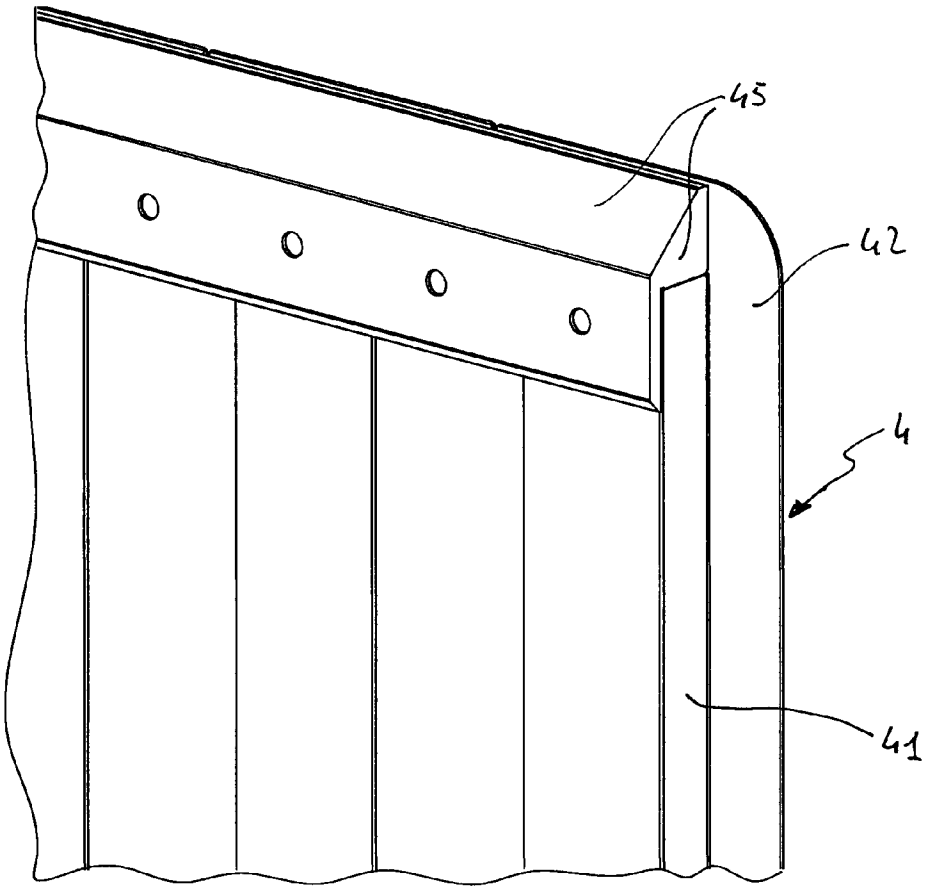
FIG. 12 depicts an element of the radiator in FIG. 4.

Alternatively, at the top, an upper crosspiece 45 may be mounted to complete the covering of the radiator by means of covers 4 (see FIG. 12), for covering the upper part of the radiator, and possibly for covering an upper manifold if any or if it integrates an upper manifold. This crosspiece 45 with a triangle-shaped section contributes to enhance the thermal exchange because it uniforms the thermal map by directly taking the heat on the cover 4 by contact. Thereby, not only the radiator maintenance is simpler, but its efficiency is also enhanced due to the presence of covers and possibly of a crosspiece adapted to increase the heat exchange surface of the radiator.

Moreover, as the cover and crosspiece are removable, they may be easily disassembled to be washed or repainted or simply replaced.

The upper crosspiece 45 serves to be associated with an upper part of the radiator to increase the exchange surface thereof by transmitting the heat from the radiating elements 33 to the upper part of the covers 42. Such a crosspiece 45 is configured so as to confer a structural rigidity, allow the assembly of additional components or accessories such as, for example, the upper support 2, in particular its second part 90; configured so as to protect the user from contact with surfaces with sharp edges related to the upper part of radiating elements 33 and toothed tabs 41; configured so as to provide an aesthetical finishing of the upper part of the heating elements 33 and related covers 42.

Figure 14:
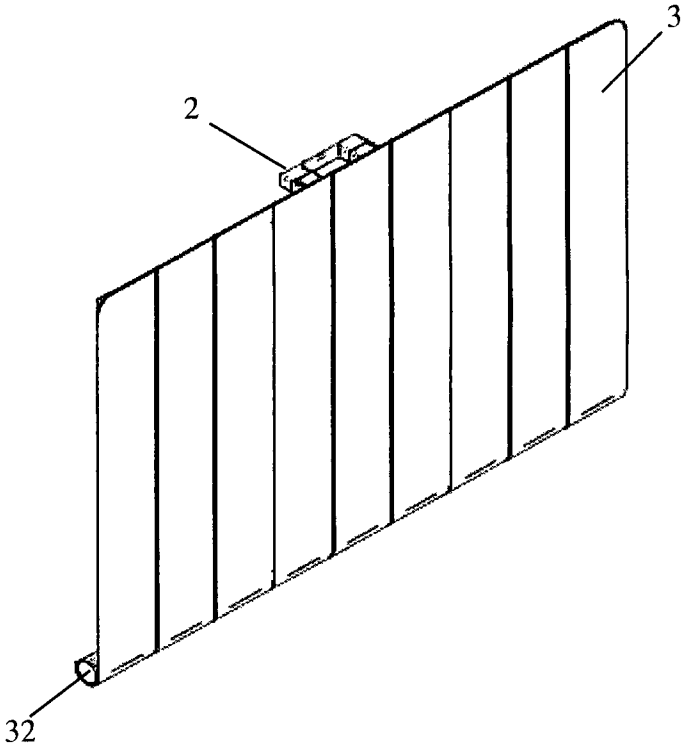
FIG. 14 depicts an axonometric view of the radiator in FIG. 13.
Figure 13:
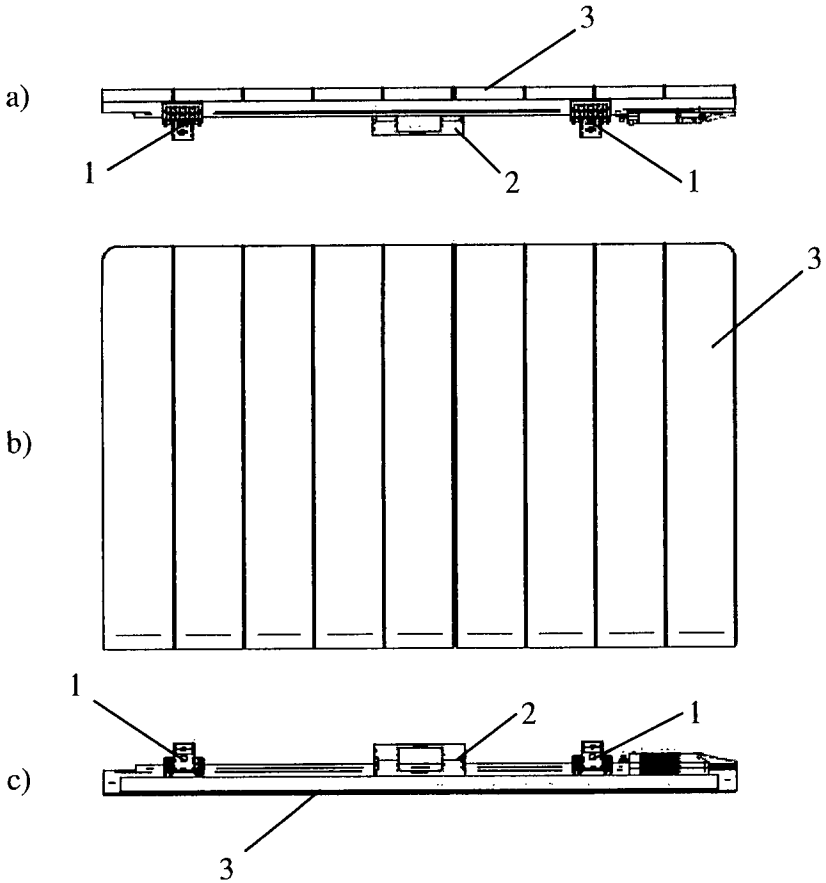
FIGS. 13*a*, 13*b*, 13*c* depict a view from the bottom (*a*), a side view (*b*) and a top view (*c*), respectively, of a radiator according to the invention.
Figure 15:
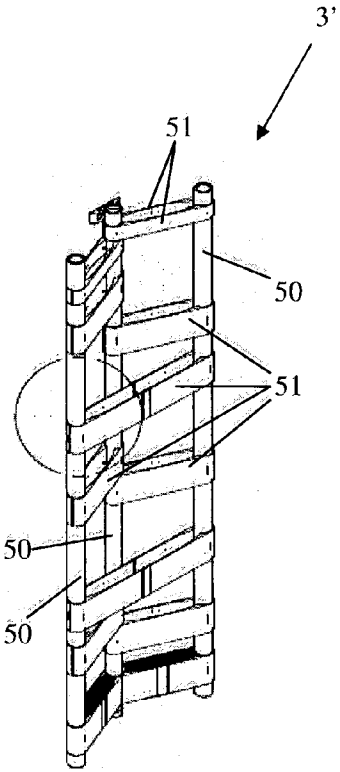
FIG. 15 depicts an axonometric view of a variant of the radiator of the invention.

FIGS. 13 and 14 depict a first variant of the radiator 3 of the invention, provided with a lower tubular manifold 32, two lower hinge supports 1 and upper blocking means 2. The Figures from 15 to 17 depict a second variant of the radiator 3' of the invention, provided with at least one lower hinge support 1 and upper blocking means 2 (not shown). This radiator 3' (FIG. 15) is also designed to serve the function of towel warmer. The radiator 3' is provided with uprights 50, for example three uprights in this advantageous variant, in the shape of cylindrical tubes and not arranged along the same plane. These uprights 50 are reciprocally connected in pairs, by pairs of transversal elements or bands 51. The bands 51, made of metal material, have ends configured so as to be coupled with the surface of the uprights 50. Each pair of bands 51 is tightened on two uprights 50 by using screws 52 or other suitable fixing means.

Figure 17:
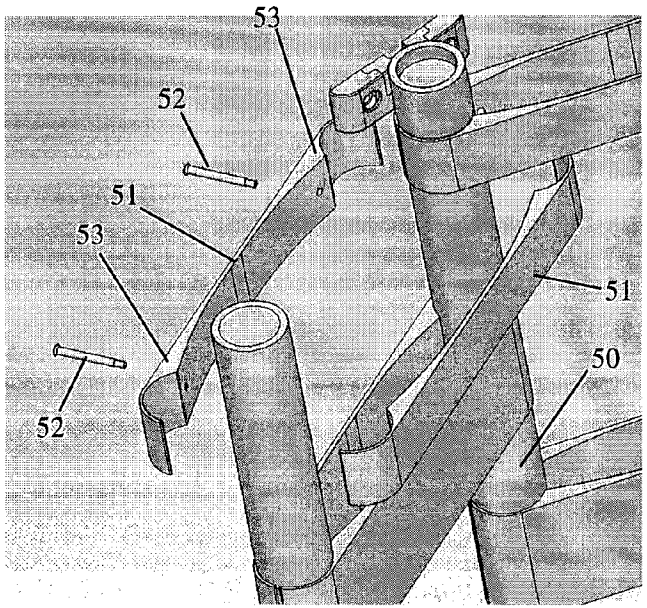
FIG. 17 depicts an exploded view of a further enlarged detail of the radiator in FIG. 15.
Figure 16:
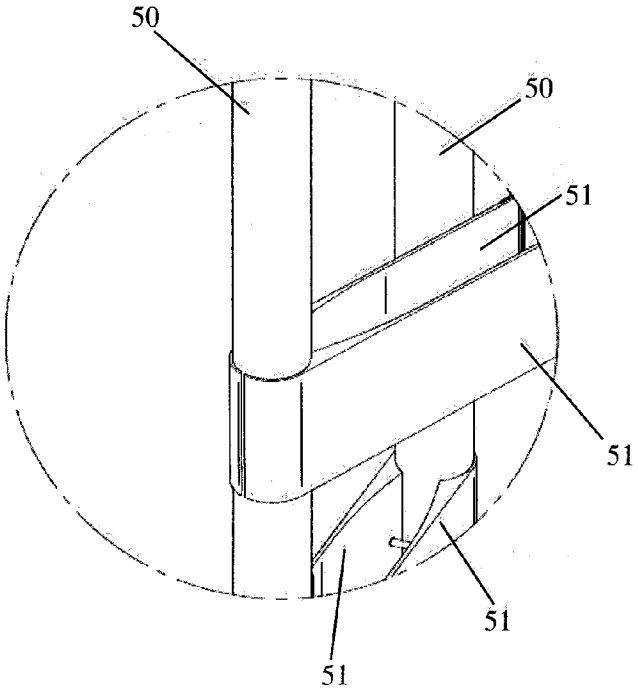
FIG. 16 depicts an enlargement of a detail of the radiator in FIG. 15.
Figure 18:
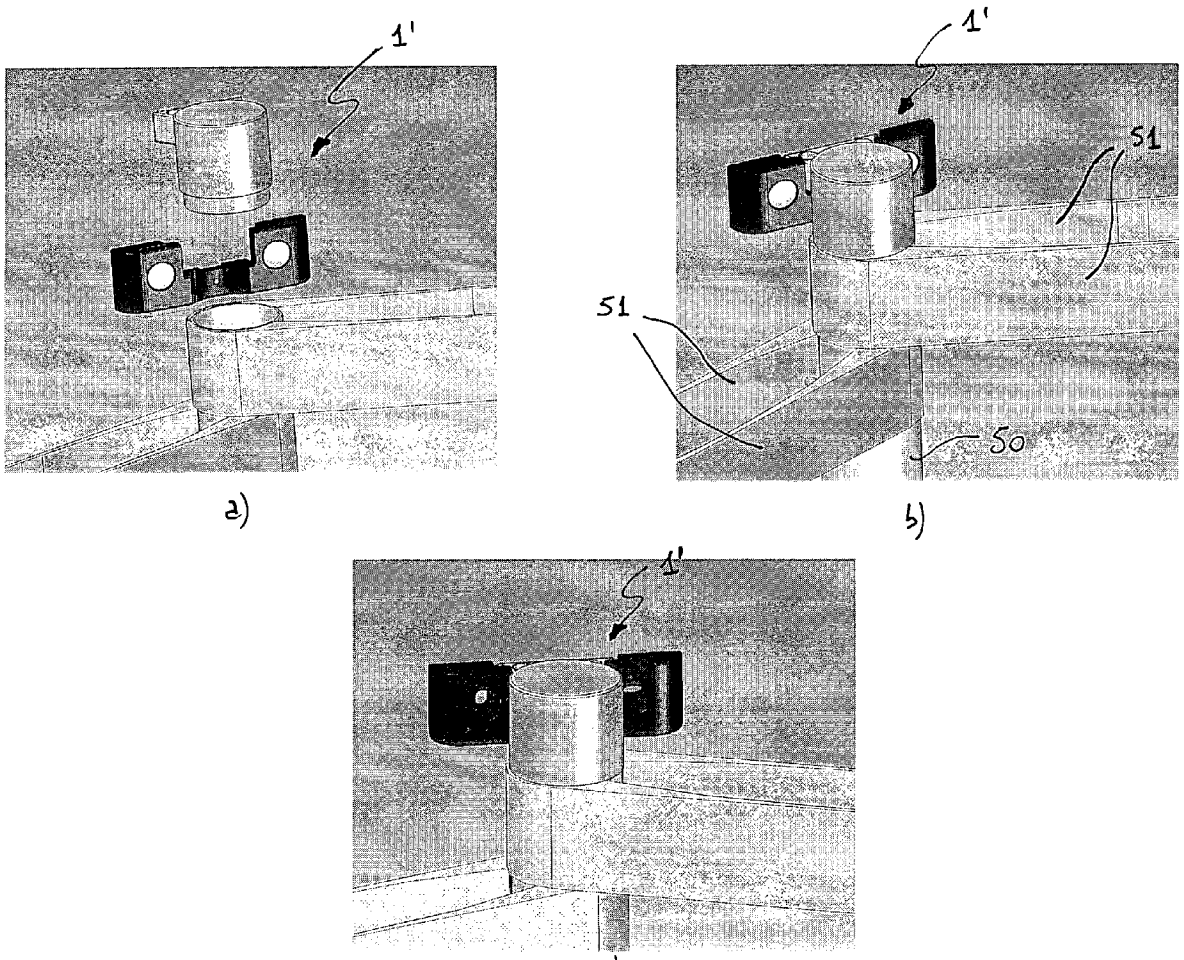
FIGS. 18*a*, 18*b*, 18*c* depict enlarged details of the radiator in FIG. 15.
Figure 20:
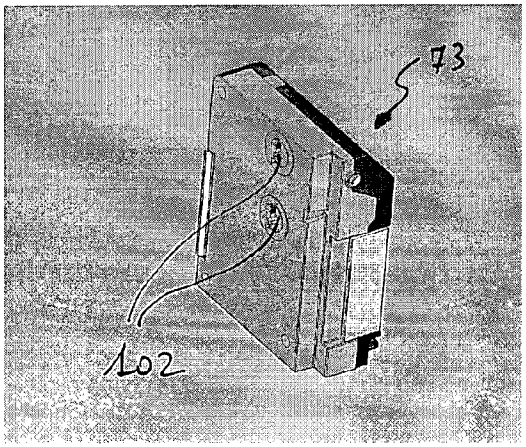
FIG. 20 depicts an enlarged element forming the radiator in FIG. 15.
Figure 19:
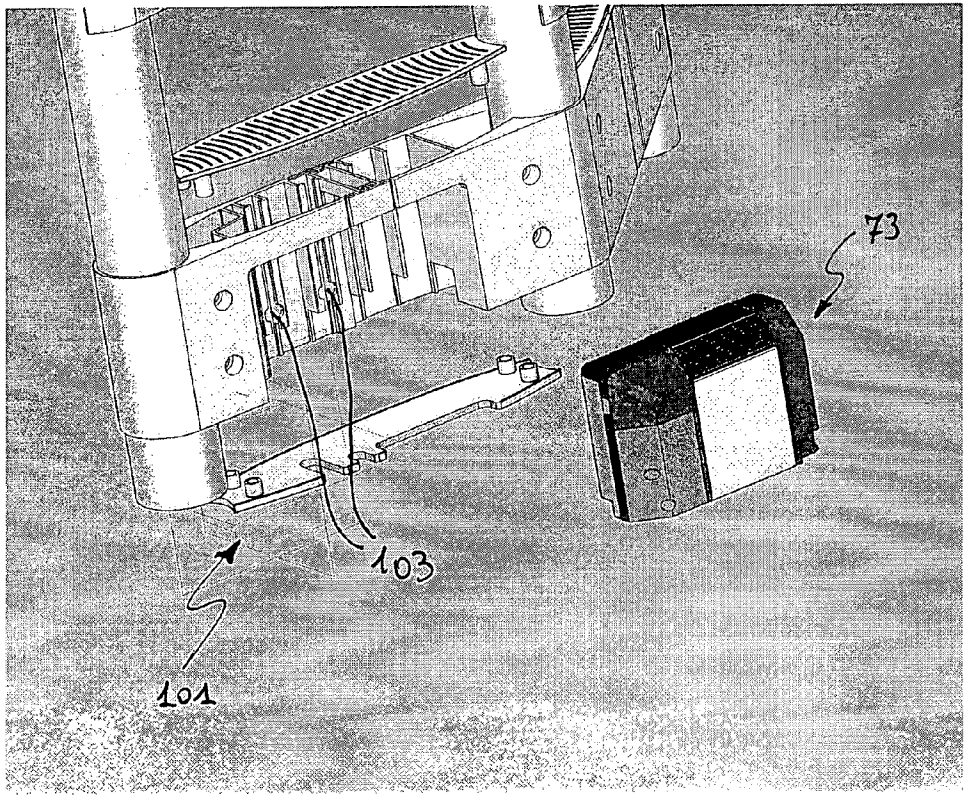
FIG. 19 depicts an enlarged detail of the radiator in FIG. 15.
Figure 22:
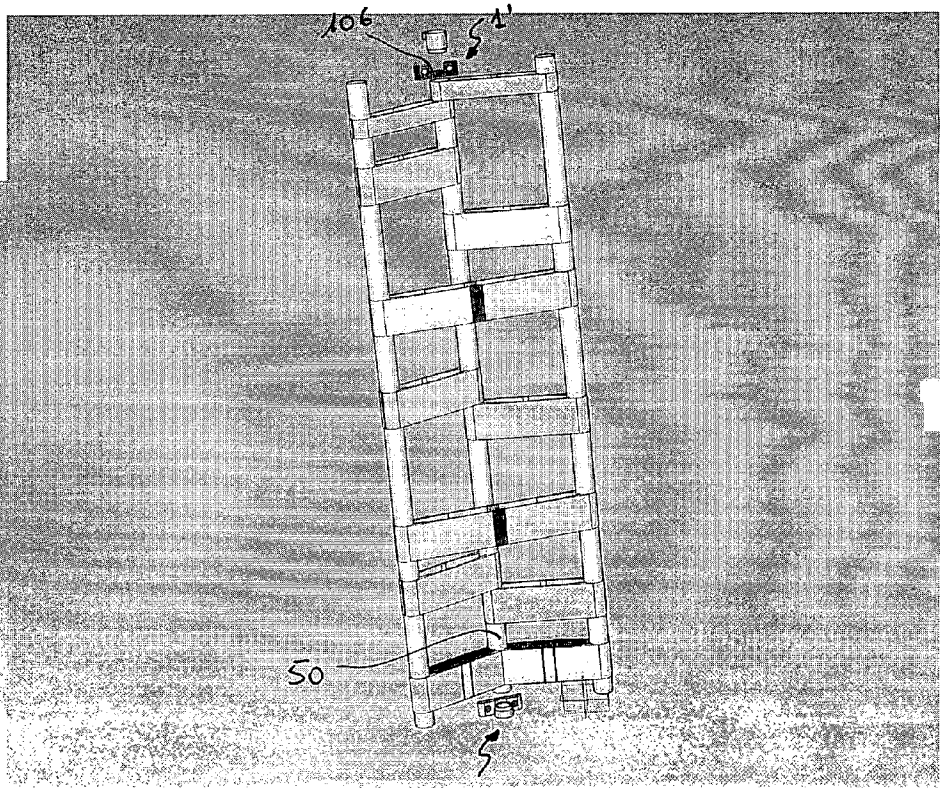
FIG. 22 depicts an axonometric view of the radiator in FIG. 15.
Figure 21:
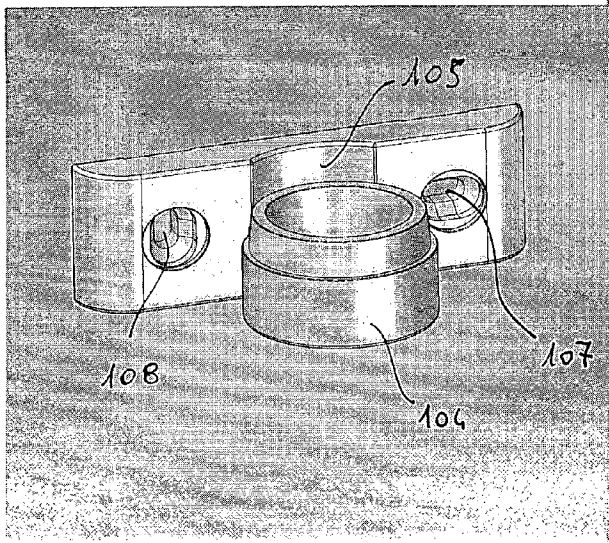
FIG. 21 depicts an enlarged detail of the radiator in FIG. 15.

Advantageously, the configuration of the bands 51 is such that they have areas 53 close to the ends (FIG. 17) having a greater thickness than the central area. In particular, the thickness of bands 51 is gradually increasing from said central area towards the areas 53 close to the coupling seats with the uprights 50, to allow an enhanced conveying of the thermal flow in the support area of possible towels or cloths. This particular configuration permits an increased heat dispersion towards the centre of bands 51 and increases the bending resistance of the bands themselves. At least one hinge support (FIG. 18) is also provided for this variant of radiator 3', which allows the radiator 3' to rotate about a vertical axis thereof to promote the insertion of towels or cloths between the transversal elements 51. A container 73 (FIGS. 19 and 20), which accommodates an electronic control and adjustment board therein, is retractably accommodated within a base block 101 within which it is fixed by means of a snap mechanism 102 which engages some slots 103 obtained on the base block itself. The hinge support systems 1' allow the wall-mounting installation by only resting the central upright 50 on the lower wall-mounted hinge 1' (FIG. 22, lower part) while inserting the shaped snap pivot 104 on the wall-mounted flange 105. The flanges 105 and 106 have suitable adjustment slots 107, 108 (FIG. 21). Said slots serve the function of centring the positioning during installation. The flanges, in particular flange 106, are made so as to allow a distance from the central upright 50 such as to compensate for the thermal expansions of the radiator during the operation thereof. Uprights 50 are directly heated by the heat-carrying fluid, while the pairs of transversal elements 51 are heated due to thermal conduction by coupling to the surface of the uprights. Further transversal elements 51 or accessories may be connected to the uprights 50. The elements and features disclosed in the various preferred embodiments may be combined without however departing from the scope of protection of the present application.

The invention claimed is:

1. A radiator comprising
a tubular manifold,
a fastening system having:
at least one hinge support comprising
a bracket and a protrusion protruding from the bracket,
a connecting body
a hole defining a seat of a pivot with a pivot axis, integral with either the bracket or the connecting body, the bracket being adapted to be wall-mounted so that the pivot axis is parallel to the wall, and
blocking means adapted to prevent or allow a rotation of said radiator with respect to said pivot axis, in order to keep the radiator in a predetermined position with respect to the wall, when mounted, characterised in that
the tubular manifold has a longitudinal groove of substantially C-shaped profile section and a sliding bar inserted in said longitudinal groove and fixed to said connecting body, and in that the bracket has a first abutment surface, the connecting body has a second abutment surface for abutting against the first abutment surface, upon rotation of the radiator in respect of the pivot axis.

2. The radiator according to claim 1, wherein said predetermined position is comprised between a proximal position and a distal position with respect to said wall.

3. The radiator according to claim 2, wherein said part of the radiator is either under or by the side of or above a wall-mounted assembly configuration.

4. The radiator according to claim 3, wherein said protrusion is shaped to accommodate a removable completion element, so that said hole is defined when said completion element is associated with said protrusion.

5. The radiator according to claim 1, wherein said blocking means comprise a second fixing bracket in which a first seat and a second seat are obtained, said second bracket being adapted to be fixed to the wall so that said first seat is perpendicular to the wall and said second seat is perpendicular to said first seat, thus intercepting it; a first pin adapted to be either directly or indirectly integral with a second part of the radiator and adapted to engage said first seat; a second pin adapted to engage said second seat to intercept said first pin in order to block it in the first seat.

6. The radiator according to claim 1, wherein said blocking means comprise a button with a return spring, which permits unfastening by means of pressure thereon, and a deformable plastic stop which, by working by interference with a first pin, offers a calibrated resistance to the unblocking thus avoiding accidental unfastening.

7. The radiator comprising the fastening system according to claim 1, wherein said at least one support is adapted to hinge a part of the radiator to a wall, so as to make the radiator pivotally associated with the wall, being able to rotate between a first distal position and a second proximal position to said wall.

8. The radiator according to claim 7, wherein said radiator blocking means are provided in one of the first distal and second proximal positions.

9. The radiator according to claim 7, wherein said radiator is adapted to be hinged to a wall by a lower or upper or side part.

10. The radiator according to claim 7, comprising hollow radiating elements connected to the hollow manifold, and comprising at least one cover adapted to be fastened to one or more of the radiating elements thus increasing the heat exchange surface thereof.

11. The radiator according to claim 10, wherein said cover comprises at least one pair of toothed tabs adapted to engage onto one or more of said radiating elements.

12. The radiator according to claim 11, wherein said cover comprises at least an area shaped to adhere to a manifold of the radiator.

13. The radiator according to claim 7, further comprising an upper crosspiece adapted to be associated to an upper part of the radiator to increase its exchange surface by transmitting the heat from the radiating elements to the upper part of the covers.

14. The radiator according to claim 7, wherein there are provided uprights not arranged along a same plane, which are reciprocally connected in pairs by means of pairs of transversal elements having ends shaped so as to couple with the surface of the uprights.

15. The radiator according to claim 14, wherein said transversal elements have corresponding end areas which are thicker than a central area thereof to allow enhanced conveying of the thermal flow in the support area of possible towels or cloths.

16. The radiator according to claim 15, wherein the thickness of said transversal elements gradually increases from said central area towards the end areas in proximity of coupling seats with the uprights.

17. The radiator according to claim 15, further comprising an electronic control container retractably accommodated within a base block, within which it is fixed by means of a snap mechanism which engages on some slots of the base.

18. The radiator according to claim 2, wherein said blocking means comprise a second fixing bracket in which a first seat and second seat are obtained, said second bracket being adapted to be fixed to the wall so that said first seat is perpendicular to the wall and said second seat is perpendicular to said first seat, thus intercepting it; a first pin adapted to be either directly or indirectly integral with a second part of the radiator and adapted to engage said first seat; a second pin adapted to engage said second seat to intercept said first pin in order to block it in the first seat.

19. The radiator according to claim 2, wherein said blocking means comprise a button with a return spring, which permits unfastening by means of pressure thereon, and a deformable plastic stop which, by working by interference with a first pin, offers a calibrated resistance to the unblocking thus avoiding accidental unfastening.

20. The radiator according to claim 8, wherein said radiator is adapted to be hinged to a wall by a lower or upper or side part.

* * * * *